US008708588B2

(12) United States Patent
Chen et al.

(10) Patent No.: US 8,708,588 B2
(45) Date of Patent: Apr. 29, 2014

(54) HORIZONTAL ADJUSTMENT DEVICE OF UPPER BASE OF BARCODE PRINTER

(75) Inventors: Wei Lun Chen, New Taipei (TW); Sheng Chia Chen, New Taipei (TW)

(73) Assignee: TSC Auto ID Technology Co., Ltd., Taipei (TW)

( * ) Notice: Subject to any disclaimer, the term of this patent is extended or adjusted under 35 U.S.C. 154(b) by 228 days.

(21) Appl. No.: 13/366,433

(22) Filed: Feb. 6, 2012

(65) Prior Publication Data

US 2013/0076845 A1 Mar. 28, 2013

(30) Foreign Application Priority Data

Sep. 22, 2011 (TW) ..... 100217772 U

(51) Int. Cl.
*B41J 2/32* (2006.01)
*B41J 25/00* (2006.01)
*B41J 2/35* (2006.01)

(52) U.S. Cl.
CPC . *B41J 25/001* (2013.01); *B41J 2/35* (2013.01)
USPC ..... 400/120.17; 347/198; 400/691

(58) Field of Classification Search
USPC ..... 400/120.16, 120.17, 691, 693, 149; 347/197, 198
See application file for complete search history.

(56) References Cited

U.S. PATENT DOCUMENTS

2006/0140697 A1* 6/2006 Lu ..... 400/56
2006/0221127 A1* 10/2006 Lee ..... 347/42
2008/0186375 A1* 8/2008 Suzuki et al. ..... 347/198
2012/0019592 A1* 1/2012 Chang ..... 347/37

FOREIGN PATENT DOCUMENTS

JP 11254715 A * 9/1999 ..... B41J 2/32

* cited by examiner

*Primary Examiner* — Daniel J Colilla
(74) *Attorney, Agent, or Firm* — Rosenberg, Klein & Lee

(57) ABSTRACT

A horizontal adjustment device of upper base of barcode printer includes a barcode printer chassis formed with at least one threaded hole. A printing-device upper base is mourned to a chassis side wall of the barcode printer, and having a through bore. At least one adjustment bolt has an end received through the through bore, and is rotatably coupled with an end of the through bore. The adjustment bolt has an opposite end forming at least one screwing engagement section. The screwing engagement section engages with the threaded hole, and another end of the adjustment bolt is rotatably received in the opposite end of the through bore. At least one adjustment threaded fastener engages the adjustment bolt so that the printing-device upper base is adjusted to move horizontally by rotating the adjustment threaded fastener and the adjustment bolt.

5 Claims, 8 Drawing Sheets

HORIZONTAL ADJUSTMENT DEVICE OF UPPER BASE OF BARCODE PRINTER

BACKGROUND OF THE INVENTION

1. Field of the Invention

The present invention relates to a horizontal adjustment device of upper base of barcode printer, and in particular to a printing device that is applicable to barcode printer and comprises a device for controlling horizontal displacement of an upper base of the printing device in a screwing manner to adjust left-side and right-side end gaps.

2. The Related Arts

A conventional label printer is used to in a printing operation for printing label paper. In the process of a label printer printing label papers, fine adjustment must be exercised for left-side or right-side end gap of an upper base of a printing device or a label paper. The conventional label printer can only be handled by removing bolts or opening the upper base of the printing device to carry out left-side or right-side margin of printing between the printing device and the label paper. This makes the operation of the barcode printer for adjusting left-side and right-side end gaps of the label paper very difficult and also makes the printing operation of the label printer very complicated and inconvenient. This is a major issue of the conventional label printer that has been long existing but not solved.

Prior art references are known, such as Taiwan Utility Model No. M244206, which relates to an improved structure of label paper printing mechanism, in which structure and technique for adjusting a printing head in a forward direction or backward direction are disclosed. However, no solution for handling left-side and right-side horizontal end gap for label printing was suggested. Apparently, the problem that the conventional barcode printer is hard in adjusting left-side and right-side end gaps still exists to be overcome.

SUMMARY OF THE INVENTION

The conventional label printer as discussed above suffers the issue and drawback of being hard and inconvenient for the operation of adjusting left-side and right-side printing gaps of an upper base of a printing device and a label paper that requires removal of bolts or opening the upper base of the printing device.

Thus, the primary object of the present invention is to provide a horizontal adjustment device of upper base of barcode printer, comprising a chassis of the barcode printer, a printing-device upper base, at least one adjustment bolt, and at least one adjustment threaded fastener. The chassis of the barcode printer has a surface forming at least one threaded hole. The printing-device upper base is mounted to a side wall of the chassis of the barcode printer. The printing-device upper base provides a function of printing labels and receives an end of a label paper to extend therethrough. The printing-device upper base forms therein a through bore. The adjustment bolt has an end received through the through bore of the printing-device upper base and is rotatably coupled with an end of the through bore. The adjustment bolt has an opposite end forming at least one screwing engagement section. The screwing engagement section is in engagement with the threaded hole of the chassis of the barcode printer and another end of the adjustment bolt is rotatably received in the opposite end of the through bore of the printing device. At least one adjustment threaded fastener is in threading engagement with an end of the adjustment bolt so that rotating the adjustment threaded fastener and the adjustment bolt clockwise or counterclockwise causes the printing-device upper base to horizontally move toward right or left and thus left-side or right-side end gaps of a label paper can be adjusted. As such, a horizontal adjustment device that adjusts left-side or right-side end gaps of a label paper in a screwing manner is formed.

The effectiveness of the horizontal adjustment device of upper base of barcode printer is that through engagement structure of the threaded hole of a chassis of a barcode printer and a screwing engagement of the adjustment bolt, clockwise or counterclockwise rotation of the adjustment bolt directly causes a printing-device upper base to horizontal move toward left or right and thus adjusting left-side or right-side end gaps of the printing device and a label paper to realize fast and easy adjustment of left-side and right-side end gaps of the printing device and the label paper.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
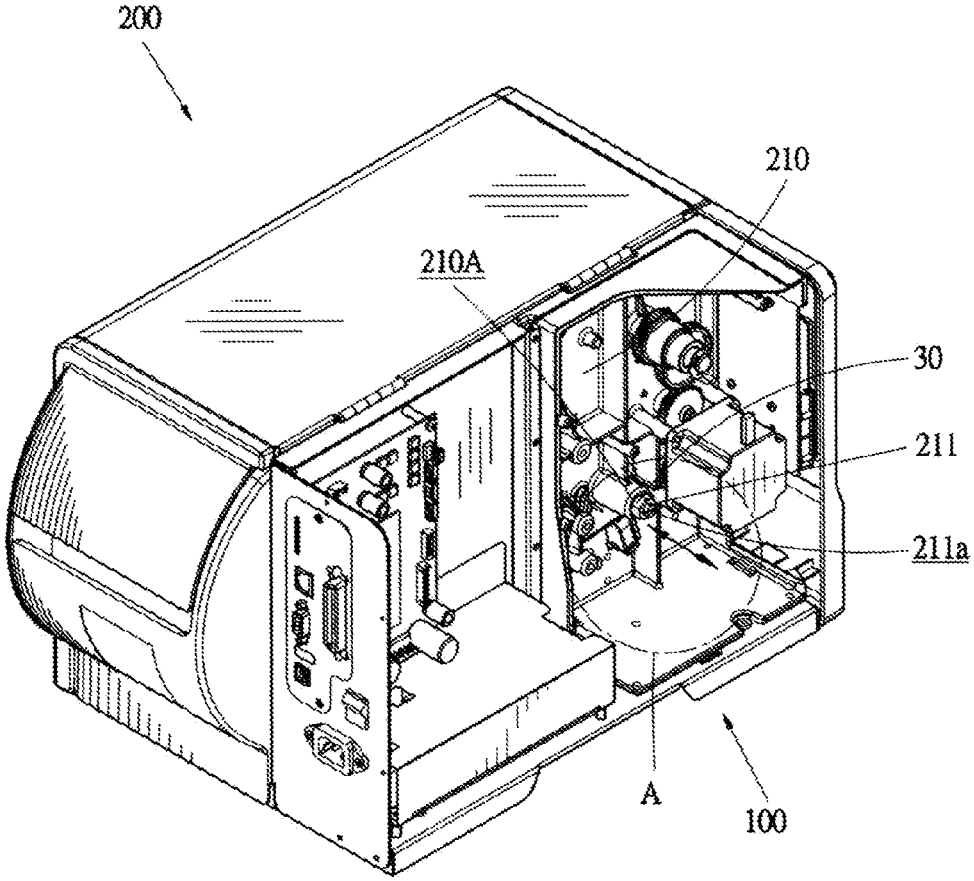
FIG. 1 is a perspective view of a horizontal adjustment device of upper base of barcode printer according to a first embodiment of the present invention.
Figure 2:
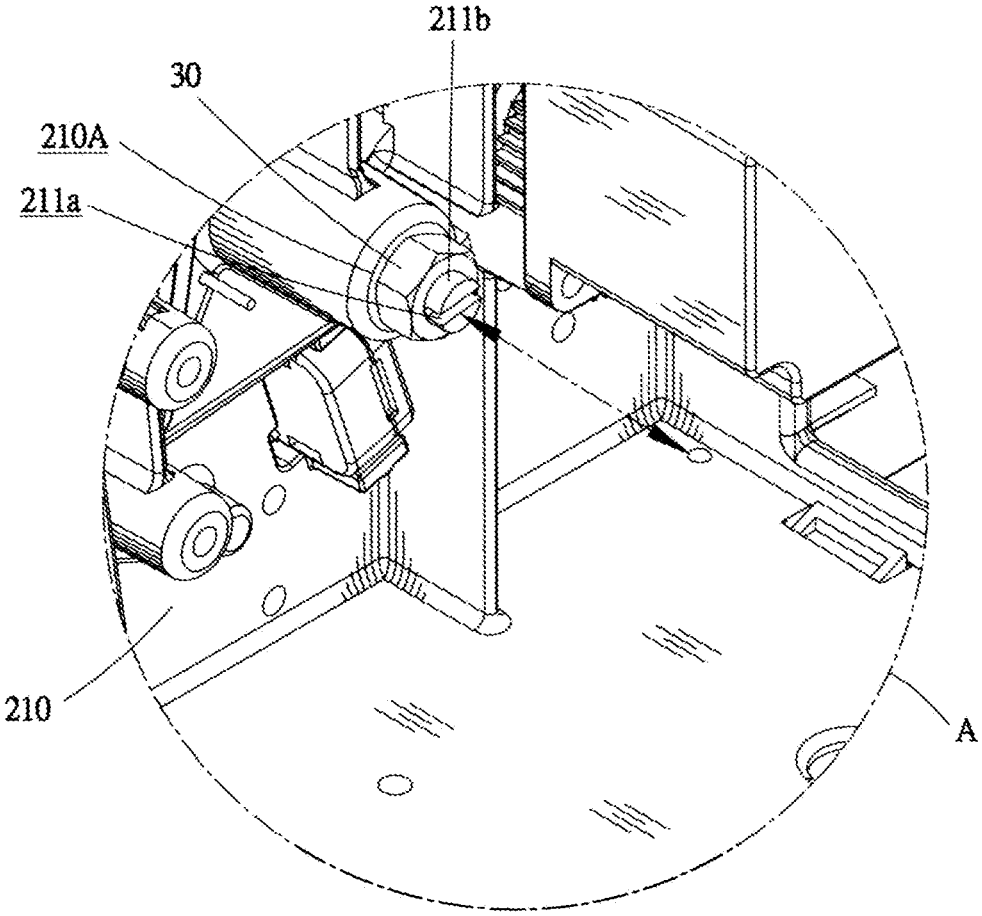
FIG. 2 is an enlarged view of circled portion A of FIG. 1.
Figure 3:
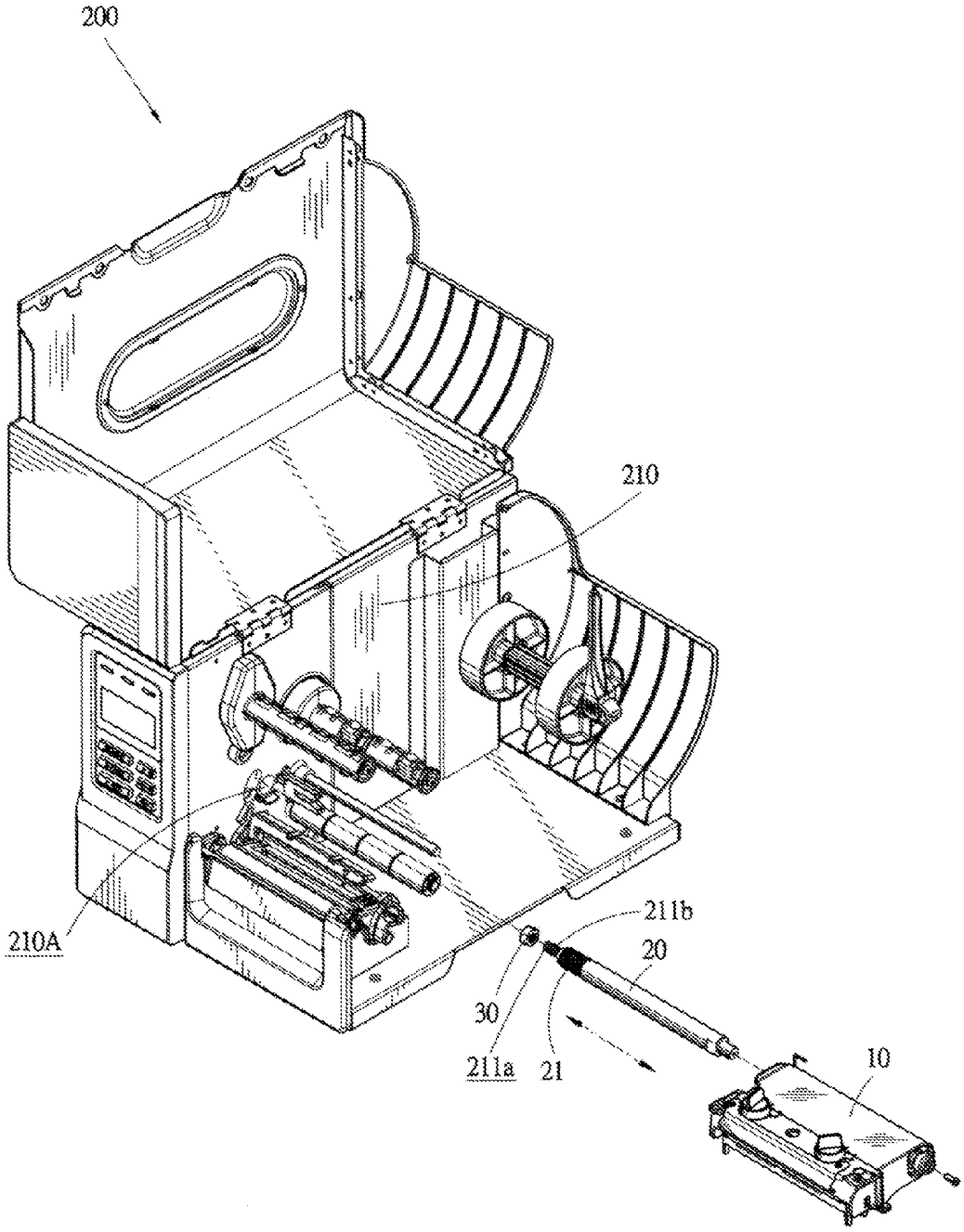
FIG. 3 is an exploded view of FIG. 1.
Figure 4:
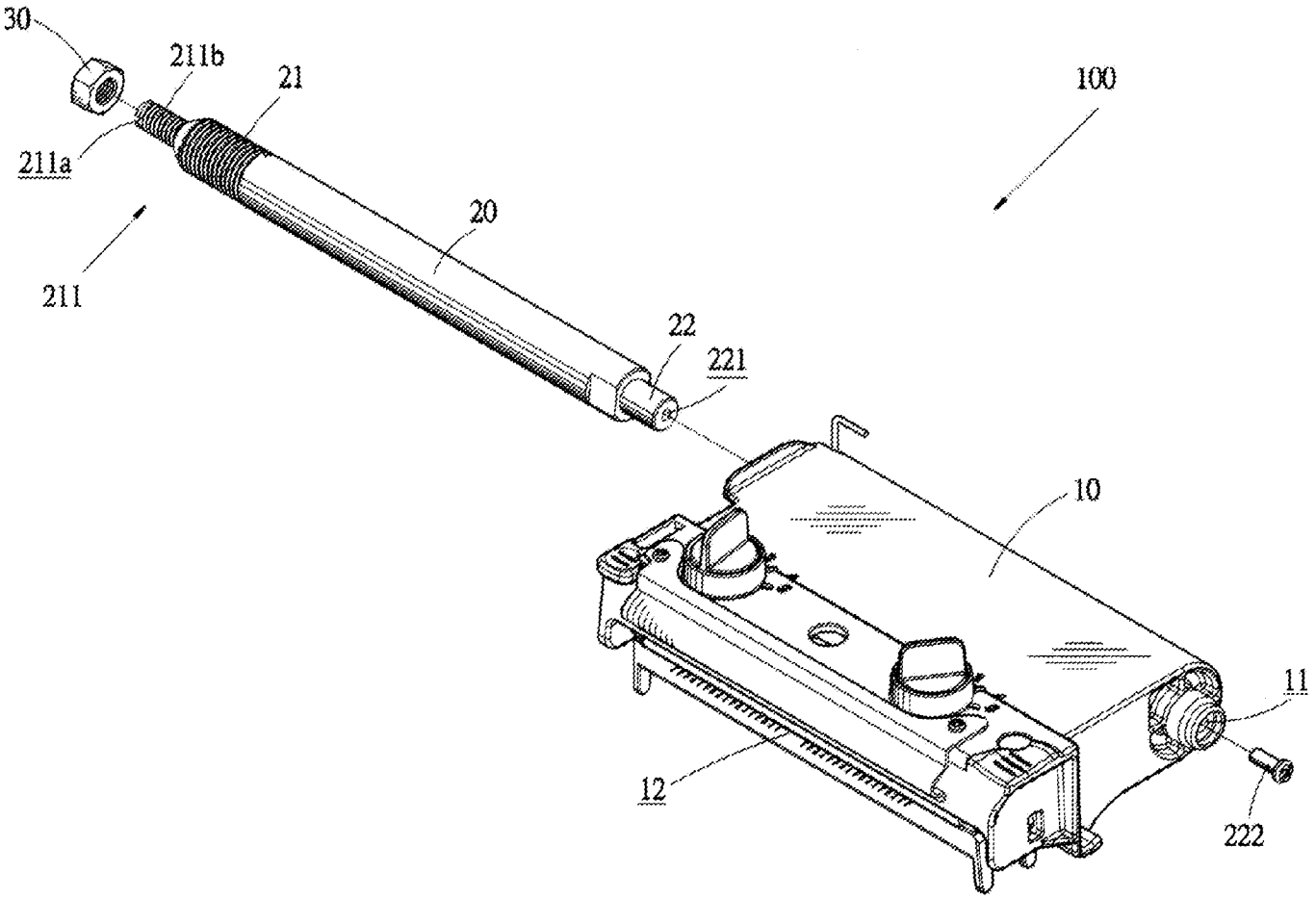
FIG. 4 is a perspective view showing a printing-device upper base, an adjustment bolt, and an adjustment threaded fastener of FIG. 3 in a detached fashion.
Figure 5:
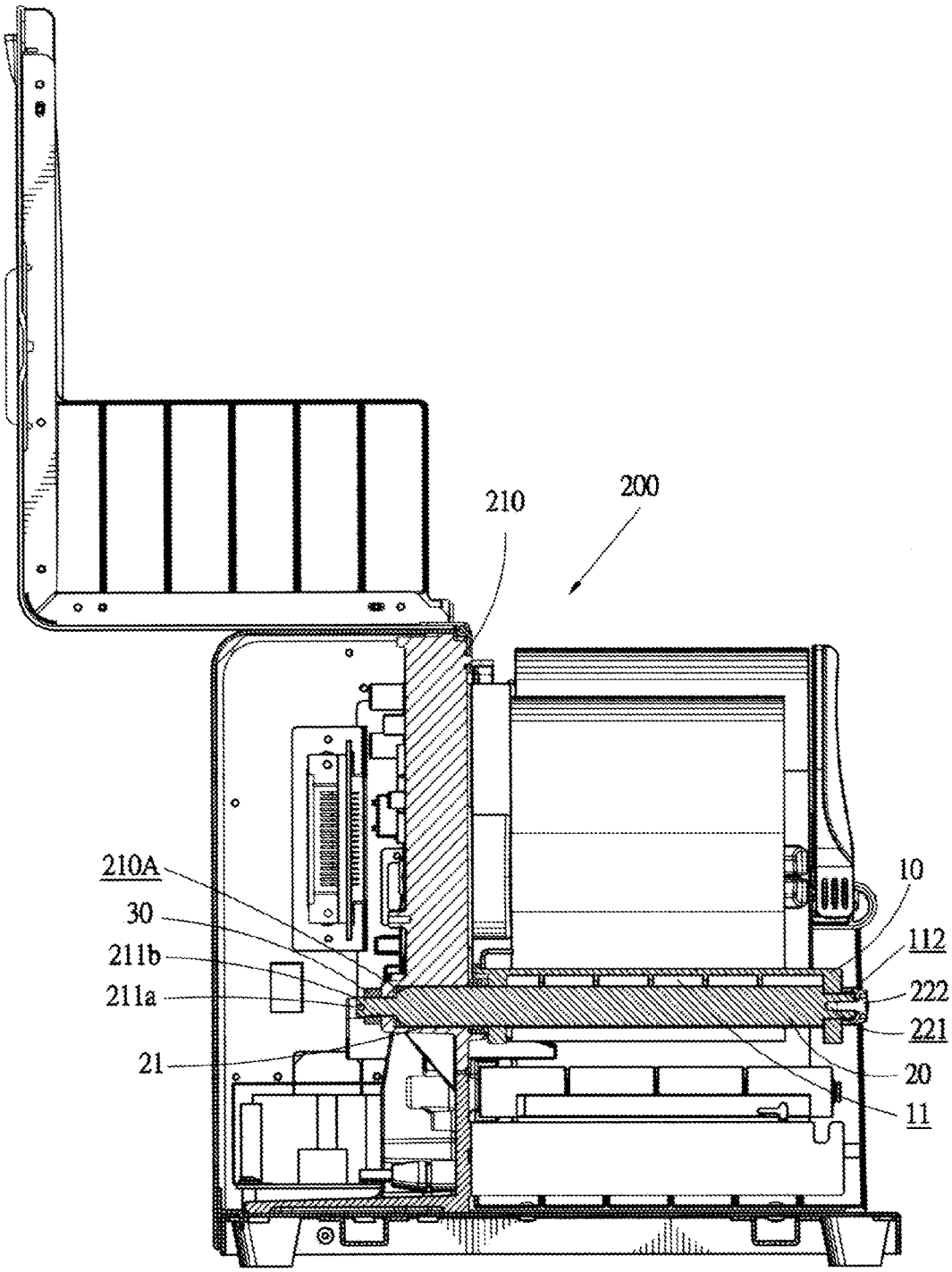
FIG. 5 is a cross-sectional view illustrating engagement structure between a threaded hole of a chassis of the barcode printer and a screwing engagement section of the adjustment bolt according to the present invention.

With reference to the drawings and in particular to FIGS. 1-5, the present invention provides a horizontal adjustment device of upper base of barcode printer, generally designated at 100, which will be referred to as the barcode printer upper base horizontal adjustment device, comprising a chassis 210 of the barcode printer 200. The chassis 210 forms at least one threaded hole 210A. At least one printing-device upper base 10, which is mounted to a side wall of the chassis 210 of the barcode printer 200. The printing-device upper base 10 provides a function of printing labels. The printing-device upper base 10 forms therein a through bore 11, and the through bore 11 has an end where a coupling mouth 112 is formed. The printing-device upper base 10 has a front face forming an opening 12

At least one adjustment bolt 20 has an end forming at least one screwing engagement section 21. The screwing engagement section 21 is not limited to any specific form and in the present invention, threading is taken as an example for illustration. The screwing engagement section 21 is extended outward to form an adjustment pin 211. The adjustment pin 211 has a surface that is cut to form at least one slit 211*a*. The adjustment pin 211 has a circumference forming a plurality of locking threads 211*b*. The adjustment bolt 20 has an opposite end forming a fitting section 22. The fitting section 22 forms a locking threaded hole 221. An end of the fitting section 22 extends from one side of the chassis 210 of the barcode printer 200 through the threaded hole 210A of the chassis 210 and further extends through the through bore 11 of the printing-device upper base 10 to fit into the coupling mouth 112. The coupling mouth 112 receives a bolt 222 inserted from outside to engage and lock the threaded hole 221, whereby the fitting section 22 is rotatably coupled to the coupling mouth 112 of the through bore 11 of the printing-device upper base 10. The screwing engagement section 21 at the opposite end of the adjustment bolt 20 is screwed into the threaded hole 210A of the chassis 210 of the barcode printer 200.

At least one adjustment threaded fastener 30 threadingly engages the locking threads 211*b* of the adjustment pin 211 at the end of the adjustment bolt 20, whereby the adjustment threaded fastener 30 serves as an element for stopping the rotation of the screwing engagement section 21 of the adjustment bolt 20 within the threaded hole 210A of the chassis 210 of the barcode printer 200.

Figure 6:
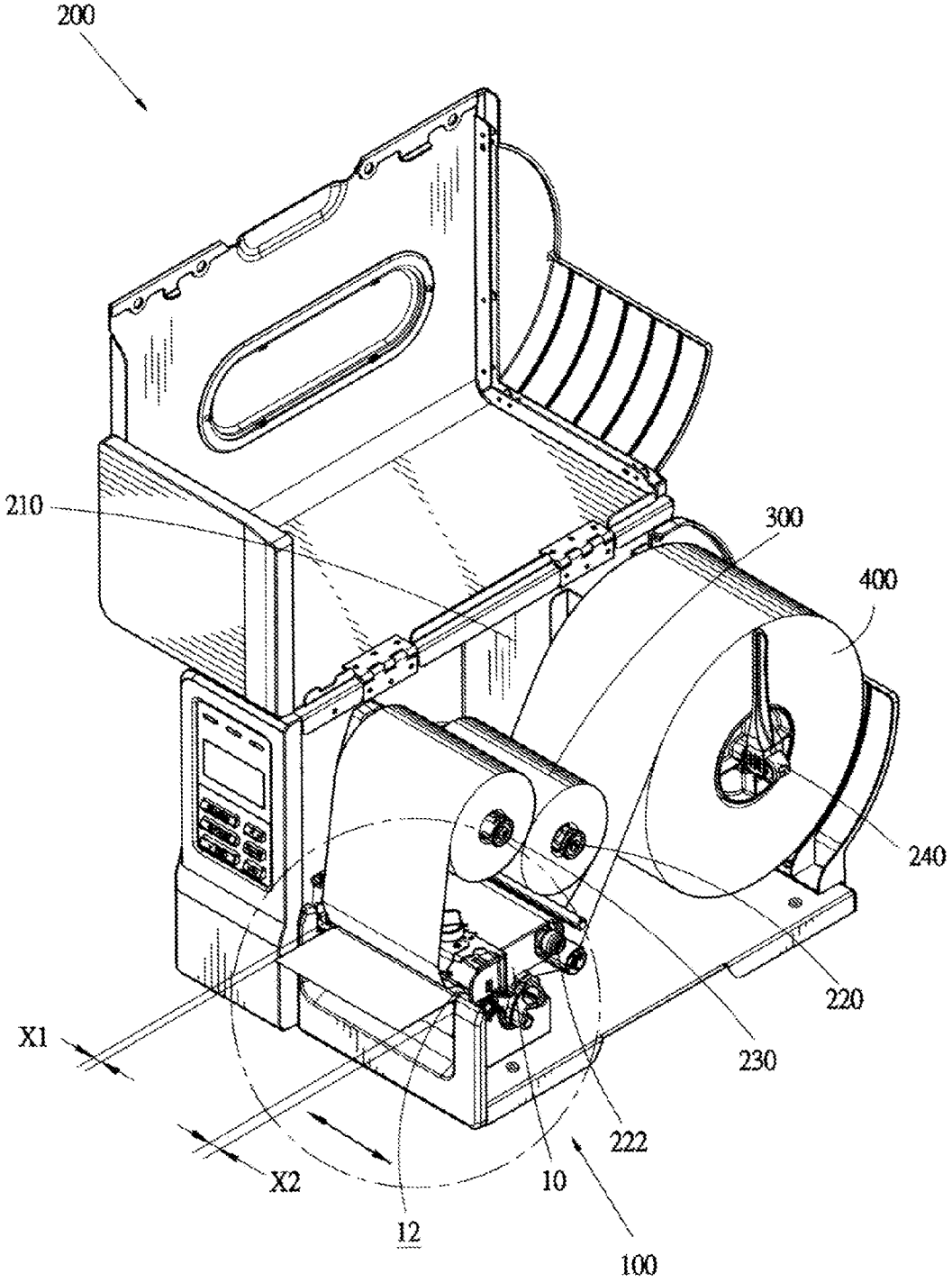
FIG. 6 is a perspective view illustrating a preferred example of application of the horizontal adjustment device of upper case of barcode printer u according to the present invention.
Figure 7:
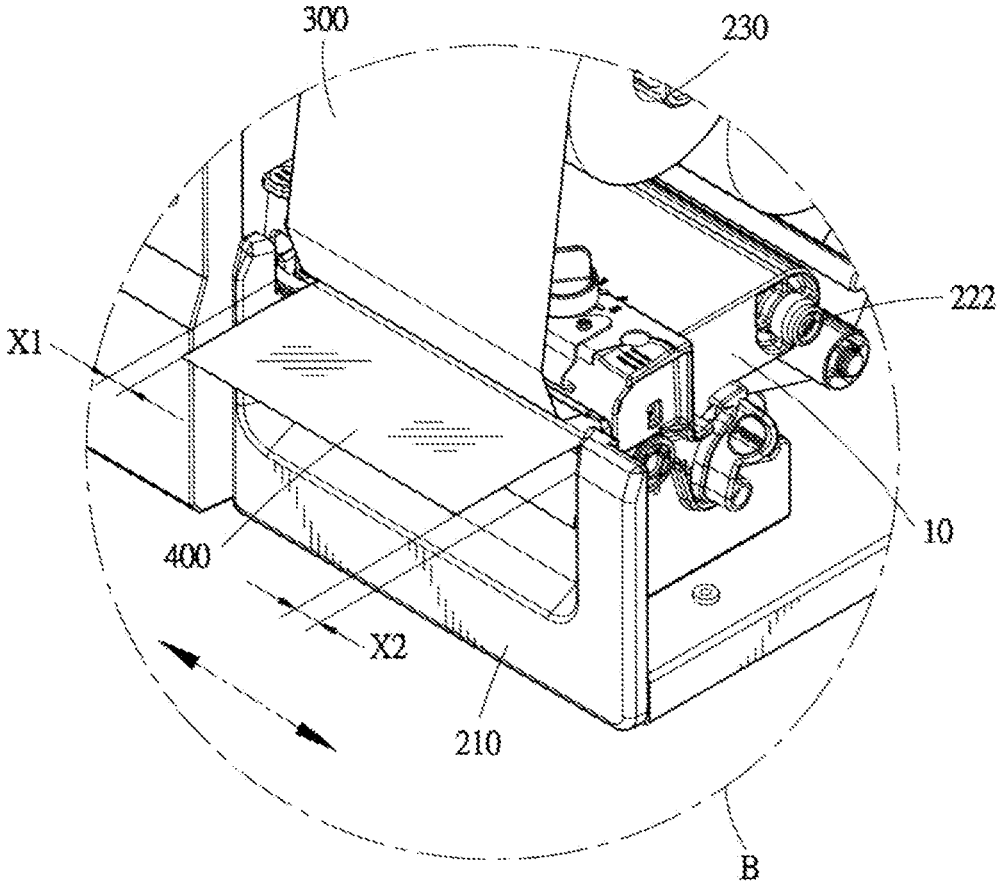
FIG. 7 is an enlarged view of circled portion B of FIG. 6.
Figure 8:
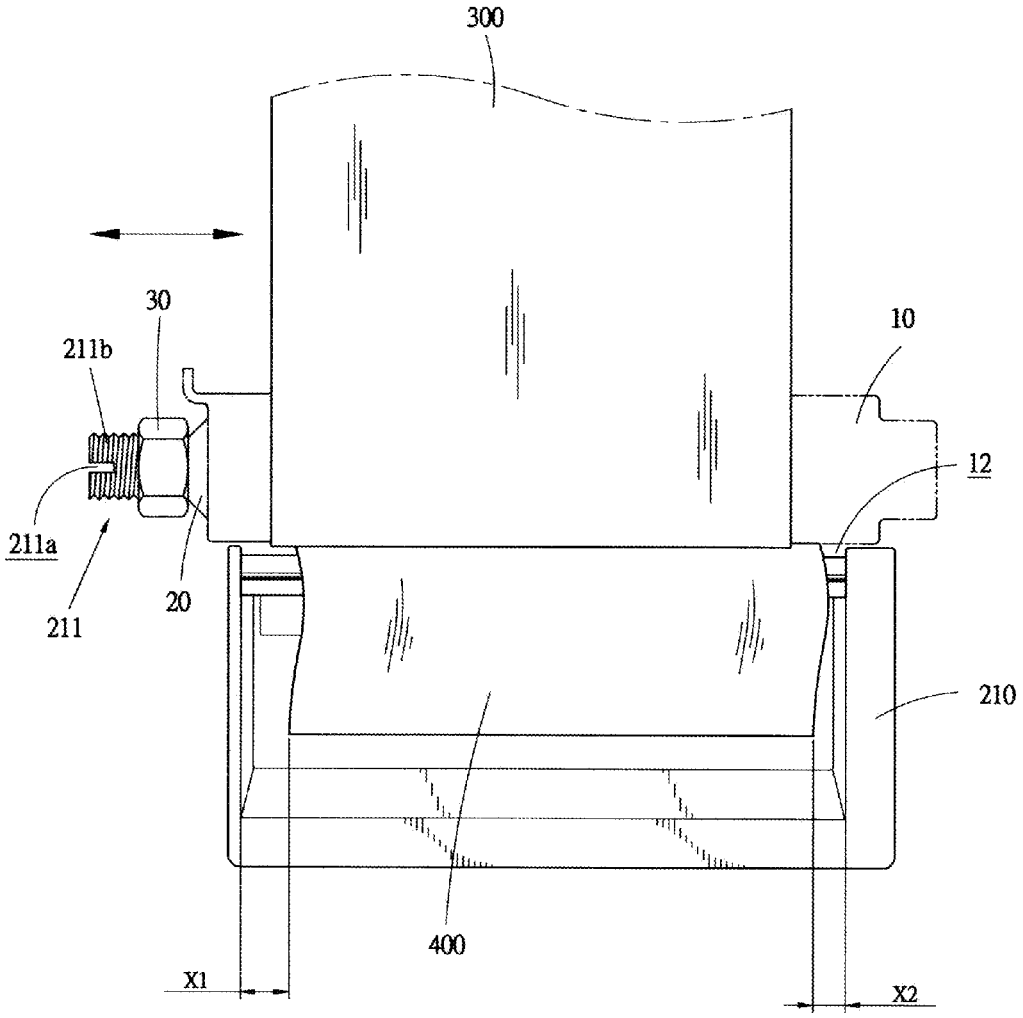
FIG. 8 is a front view illustrating a condition where the printing-device upper base is moved leftward or rightward to adjust a left-side end gap or a right-side end gap of a label paper roll.

Referring to FIGS. 6-8, a preferred example of application of the barcode printer upper base horizontal adjustment device 100 according to the present invention is illustrated, wherein the barcode printer upper base horizontal adjustment device 100 according to the present invention is shown applying to the barcode printer 200. The barcode printer 200 comprises a carbon ribbon reel 220 that carries thereon a carbon ribbon roll 300, of which an end extends inward from the underside of the printing-device upper base 10 and extends out through the opening 12 to be wound around a carbon ribbon collection shaft 230 arranged inside the barcode printer 200. The barcode printer 200 comprises a paper reel 240 that carries thereon a label paper roll 400 of which an end extends inwards from the underside of the printing-device upper base 10 and extends out through the opening 12 to be located under the carbon ribbon roll 300 so as to allow the printing-device upper base 10 to perform a label printing operation on the label paper roll 400.

In case that a label paper roll 400 of a different width is used or it is desired to adjust a left-side end gap X1 or a right-side end gap X2 (as shown in FIG. 7) of the label paper roll 400, a tool, such as a screwdriver, can be fit into the slit 211*a* formed in the adjustment pin 211 at the end of the adjustment bolt 20 and rotated clockwise or counterclockwise, or alternatively, directly gripping the adjustment threaded fastener 30 can be exercised for clockwise or counterclockwise rotation to have the screwing engagement section 21 of the adjustment bolt 20 move through engagement with the threaded hole 210A of the chassis 210 of the barcode printer 200, whereby the printing-device upper base 10 is moved horizontally toward left or right and thus adjusting the left-side end gap X1 or the right-side end gap X2 of the label paper roll 400.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A horizontal adjustment device of an upper base of a barcode printer, comprising:

a chassis of the barcode printer, which forms at least one threaded hole; a printing-device upper base being mounted to a side wall of the chassis of the barcode printer and providing a function of printing labels, the printing-device upper base forming therein a through bore, the through bore having an end where a coupling mouth is formed, the printing-device upper base having a front face forming an opening through which a carbon ribbon and label paper pass through; at least one adjustment bolt having an end forming at least one screwing engagement section, the adjustment bolt having an opposite end forming a fitting section, the fitting section forming a locking threaded hole, an end of the fitting section extending from one side of the chassis of the barcode printer through the threaded hole of the chassis and further extending through the through bore of the printing-device upper base to fit into the coupling mouth, the coupling mouth receiving a bolt inserted from outside to engage and lock the threaded hole, whereby the fitting section is rotatably coupled to the coupling mouth of the through bore of the printing-device upper base, the screwing engagement section being in engagement with the threaded hole of the chassis of the barcode printer; at least one adjustment threaded fastener engaging an end of the screwing engagement section of the adjustment bolt so that the adjustment threaded fastener serves as an element for stopping rotation of the screwing engagement section of the adjustment bolt within the threaded hole of the chassis of the barcode printer, whereby through clockwise or counterclockwise rotation of the adjustment threaded fastener, the adjustment bolt is caused to rotate clockwise or counterclockwise to have the screwing engagement section of the adjustment bolt move through engagement with the threaded hole of the chassis of the barcode printer, so as to move the printing-device upper base horizontally toward left or right and thus adjusting a left-side end gap or a right-side end gap of a label paper roll of the label paper.

2. The horizontal adjustment device of upper base of barcode printer as claimed in claim 1, wherein the screwing engagement section of the adjustment bolt comprises a plurality of threads.

3. The horizontal adjustment device of upper base of barcode printer as claimed in claim 1, wherein the screwing engagement section of the adjustment bolt is extended outward to form an adjustment pin.

4. The horizontal adjustment device of upper base of barcode printer as claimed in claim 3, wherein the adjustment pin is cut to form at least one slit.

5. The horizontal adjustment device of upper base of barcode printer as claimed in claim 3, wherein the adjustment pin has a circumference forming a plurality of locking threads.

* * * * *